United States Patent [19]

Tanase et al.

[11] Patent Number: 4,844,738

[45] Date of Patent: Jul. 4, 1989

[54] CARBIDE-DISPERSED TYPE FE-BASE SINTERED ALLOY EXCELLENT IN WEAR RESISTANCE

[75] Inventors: Teruyoshi Tanase; Hatiro Matsunaga, both of Niigata, Japan

[73] Assignee: Mitsubishi Kinzoku Kabushiki Kaisha, Tokyo, Japan

[21] Appl. No.: 109,820

[22] Filed: Oct. 16, 1987

[30] Foreign Application Priority Data

Oct. 31, 1986 [JP] Japan ..... 61-260498
Apr. 22, 1987 [JP] Japan ..... 62-99243

[51] Int. Cl.[4] ..... C22C 29/06
[52] U.S. Cl. ..... 75/241; 75/242
[58] Field of Search ..... 75/241, 242

[56] References Cited

U.S. PATENT DOCUMENTS

| | | | |
|---|---|---|---|
| Re. 21,520 | 7/1940 | Schwarzkopf | 75/241 |
| 3,380,861 | 4/1968 | Frehn | 75/241 |
| 4,121,927 | 10/1978 | Lohman et al. | 75/241 |
| 4,145,213 | 3/1979 | Oskarsson et al. | 75/241 |
| 4,487,630 | 12/1984 | Crook et al. | 420/12 |
| 4,584,019 | 4/1986 | Kesting | 420/12 |
| 4,604,781 | 8/1986 | Rankin, III | 420/12 |
| 4,636,252 | 1/1987 | Yoshimura et al. | 75/241 |

FOREIGN PATENT DOCUMENTS

| | | | |
|---|---|---|---|
| 57-198240 | 12/1982 | Japan | 75/241 |
| 58-130259 | 8/1983 | Japan | 75/241 |
| 60-36601 | 2/1985 | Japan | 420/12 |
| 60-67644 | 4/1985 | Japan | 75/241 |
| 60-135556 | 7/1985 | Japan | 420/12 |
| 60-194048 | 10/1985 | Japan . | |
| 61-60862 | 3/1986 | Japan . | |
| 61-164859 | 4/1986 | Japan | 75/241 |

*Primary Examiner*—Stephen J. Lechert, Jr.
*Assistant Examiner*—Eric Jorgensen
*Attorney, Agent, or Firm*—Frishauf, Holtz, Goodman & Woodward

[57] ABSTRACT

A carbide-dispersed type Fe-base sintered alloy which has excellent wear resistance and consists essentially of: 4–6.5% by weight C; 10–40% by weight Cr; 2–25% by weight Mo; 0.1–5% by weight at least one element selected from the group consisting of Ti, Zr, Hf, V, Nb, and Ta; and the balance of Fe and inevitable impurities. If required, the alloy may further contain 0.1–15% by weight at least one element selected from the group consisting of Co and Ni, and/or 0.1–10% by weight W. The alloy has a structure wherein carbides are dispersed throughout the matrix in an amount of at least 71% by volume, and the alloy has at least 97% theoretical density ratio.

8 Claims, No Drawings

CARBIDE-DISPERSED TYPE FE-BASE SINTERED ALLOY EXCELLENT IN WEAR RESISTANCE

BACKGROUND OF THE INVENTION

This invention relates to a carbide-dispersed type Fe-base sintered alloy which exhibits excellent wear resistance when used as a sliding part required to have high lubricity enough to be in smooth sliding contact with a counterpart, e.g. a sliding part in an internal combustion engine using liquefied petroleum gas (LPG) as fuel.

Carbide-dispersed type Fe-base sintered alloys as well as chilled castings are generally employed as sliding parts in internal combustion engines using liquefied petroleum gas (hereinafter abbreviated as LPG) as fuel, such as rocker arms and valve lifters. Such Fe-base sintered alloys have such a structure that carbides of Fe, Cr, and/or Mo are dispersed in the matrix, as disclosed, e.g. in Japanese Provisional Patent Publications (Kokai) Nos. 60-194048 and 61-60862.

However, sliding parts in internal combustion engines are placed under very severe operating conditions because LPG has so poor lubricity that no oil film can easily be present between the sliding parts and their counterparts. Under such severe operating conditions, conventional carbide-dispersed type Fe-base sintered alloys, like conventional chilled castings, are subject to metal adhesion with their counterparts, since the percetage of carbides dispersed in the matrix is about 60% by volume at most. In a worse case, sliding parts have scuffing wear of a depth of the order of 0.5 mm and often heavily damage or abrade surfaces of their counterparts (e.g. a cam member if the sliding part is a rocker arm).

SUMMARY OF THE INVENTION

It is the object of the invention to provide a carbide-dispersed type Fe-base sintered alloy which has excellent wear resistance and has a greatly reduced possibility of damaging or abrading its counterpart, thereby exhibiting excellent performance over a long period of time if employed as a sliding part required to have high lubricity in an internal combustion engine, e.g. using LPG as fuel.

To attain the above object, the present invention provides a carbide-dispersed type Fe-base sintered alloy which consists essentially of: 4–6.5% C; 10–40% Cr; 2–25% Mo; 0.1–5% at least one element selected from the group consisting of Ti, Zr, Hf, V, Nb, and Ta; and the balance of Fe and inevitable impurities. If required, the alloy may further contain 0.1–15% at least one element selected from the group consisting of Co and Ni, and/or 0.1–10% W. The alloy has a structure wherein carbides are dispersed throughout the matrix in an amount of at least 71% by volume, and the alloy has at least 97% theoretical density ratio.

The above and other objects, features, and advantages of the invention will be more apparent from the ensuing detailed description.

DETAILED DESCRIPTION

Under the aforestated circumstances, the present applicants have made many studies in order to develop a material suitable particularly for use as sliding parts of internal combustion engines using LPG as fuel, they have reached the following finding:

A carbide-dispersed type Fe-base sintered alloy which consists essentially of: 4–6.5% C; 10–40% Cr; 2–25% Mo; 0.1–5% at least one element selected from the group consisting of Ti, Zr, Hf, V, Nb, and Ta; and if required, 0.1–15% at least one element selected from the group consisting of Co and Ni, and/or 0.1–10% W; and the balance of Fe and inevitable impurities, the alloy having carbide dispersed throughout the matrix in an amount of at least 71% by volume, and having at least 97% theoretical density ratio, has such a structure that the dispersed carbides almost completely occupy the whole matrix so that the total area of metal exposed to the surfaces of the matrix is very small, thereby being free from metal adhesion of a sliding part formed by the alloy with its counterpart. Therefore, the sliding part formed of the alloy is free from scuffing wear, thus exhibiting excellent wear resistance and having a very low degree of damaging or abrading the counterpart, even if the sliding part is used in a condition where fuel with poor lubricityis used and hence an oil film runs short between the sliding part and its counterpart. Further, the alloy has high density enough to have a much reduced number of pores formed therein whereby a sliding part formed of the alloy is free from pitting water.

The present invention is based upon the above finding. The alloy according to the invention has the aforesaid chemical composition, percentage of carbides dispersed in the matrix, and theoretical density ratio. In the present specification, percentage is percent by weight except for that of the theoretical density ratio, unless otherwise specified.

The chemical composition, percentage of carbides dispersed in the matrix, and theoretical density ratio of the alloy according to the invention have been limited as stated before, for the following reasons:

(a) C

The element C is partly resolved in solid solution in the matrix to strengthen same, and the remaining part of C reacts with Cr, Mo, and Fe to form double carbides to enhance the wear resistance and resistance to metal adhesion. However, if the C content is less than 4%, the percentage of carbides dispersed in the matrix will be less than 71% by volume, thereby failing to obtain desired wear resistance and metal adhesion resistance, whereas if the C content exceeds 6.5%, free carbon will be formed in the matrix, thus resulting in degraded strength of the alloy. Therefore, the C content has been limited within a range form 4 to 6.5%. A preferable range of the C content is from 4.2 to 5%.

(b) Cr

The element Cr is also partly resolved in solid solution in the matrix to enhance the heat resistance and corrosion resistance. Cr also reacts with C, and Mo and/or Fe to form double carbides having a low degree of damaging or abrading a counterpart, thereby enhancing the wear resistance of the alloy. However, if the Cr content is less than 10%, the above actions cannot be performed to a satisfactory extent, while if it exceeds 40%, the alloy will have degraded stregnth. This is why the Cr content has been limited within a range from 10 to 40%. A preferable range of the Cr content should be from 15 to 30%.

(c) Mo

The element Mo is partly resolved in solid solution in the matrix to strengthen same, while the remainder of Mo forms double carbides other than double carbides mainly composed of Cr and Fe to enhance the wear resistance of the alloy and also to restrain coarsening of grains of the double carbides mainly composed of Cr and Fe, dispersed in the matrix during sintering to thereby prevent degradation in the wear resistance and strength of the alloy. However, if the Mo content is smaller than 2%, the above results cannot be obtained to a desired degree, and on the other hand, if it is in excess of 25%, it will result in degraded strength of the alloy. Therefore, the Mo content has been limited within a range from 2 to 25%. Best results can be obtained if the Mo content is from 3 to 10%.

(d) Ti, Zr, Hf, V, Nb, and Ta

These elements react in large part with Fe, Cr, Mo, and C to form double carbides, and the other parts of them form by themselves carbides, thereby further enhancing the hardness of the alloy and hence the wear resistance thereof. However, if the total content of one or more of these elements is less than 0.1%, the alloy cannot have desired hardness, whereas in excess of 5%, the single carbides formed by themselves in the sliding part have high degrees of damaging or abrading the counterpart, causing great abrasion thereof. Thus, the total content has been limited within a range from 0.1 to 5%. Preferably, it should be from 0.5 to 3%.

(e) Co and Ni

The elements Co and Ni are resolved in solid solution in the matrix to enhance the strength of the alloy, and therefore may be contained according to necessity in such a case where particularly high strengh is required of the alloy. However, if the total content of one or both of these elements is less than 0.1%, the strength of the alloy cannot be enhanced to a desired degree, whereas even if the content is in excess of 15%, no further enhancement of the alloy strength will be obtained. Therefore, the Co and/or Ni content has been limited witin a range from 0.1 to 15%, and preferably from 1 to 6 %.

(f) W

The element W is partly resolved in solid solution in the matrix to strengthen same, and the other part of W is resolved in solid solution in double carbides dispersed in the matrix to enhance the hardness of the double carbides and hence further enhance the wear resistance of the alloy. For these actions, W may be added according to necessity in such a case where the counterpart is formed of a hard material. However, if the W content is less than 0.1%, the wear resistance cannot be enhanced to a desired extent, whereas even in excess of 10%, no further enhancement of the wear resistance will be obtained. Thus, the W content has been limited within a range from 0.1 to 10%, and preferably from 1 to 5%.

(g) Carbides

As stated before, in the alloy according to the invention carbides are dispersed throughout the matrix in a fashion almost completely occupying the whole matrix, to thereby restrain metal adhesion of a sliding part formed of the alloy with its counterpart so that the sliding part can exhibit excellent wear resistance and a very low degree of damaging or abrading the counterpart even if used.in a severe operating condition such as in an internal combustion engine using LPG as fuel. However, if the percentage of the dispersed carbides is less than 71% by volume, the above results cannot be ensured. Therefore, the dispersed carbide percentage has been limited to at least 71% by volume. The alloy according to the invention may be formed solely of carbides, i.e. 100% by volume of carbides, providing the same results as stated above. The dispersed carbide percentage can be freely adjusted to a desired value by suitably selecting the chemical composition and the heat treatment conditions. More specifically, to make the dispersed carbide percentage 71% by volume or more, in addition to maintaining the C content within the aforementioned range from 4 to 6.5%, a sintered body for the alloy is subjected to heat treatment immediately that the sintering treatment in such a manner that the sintered body is gradually cooled from 1000° to 600° C. in a period of time within a range from 1 to 10 hours so as to cause carbides to be precipitated in the matrix.

(h) Theoretical Density Ratio

If the percentage of the dispersed carbides exceeds 71% by volume as stated above, the alloy inevitably has degraded strength. This degradation in the alloy strength becomes so remarkable that breakage of the alloy and pitting wear of the alloy are likely to occur if the theoretical density ratio of the alloy is less than 97%. Therefore, the theeoretical density ratio has been limited to at least 97%. The theoretical density ratio can be made 97% or more by setting the sintering temperature at a suitable value which depends on the composition of the alloy in manufacturing an alloy according to the invention.

An example of the Fe-base sintered alloy according to the invention will now be described in detail.

EXAMPLE

As starting powders, powder of Fe, and powder of an Fe-55%Cr alloy, both having a mean grain size of 10 microns, powder of an Fe-15%Cr-15%Mo-4%C alloy, powder of an Fe-15%Cr-15%Mo-5%Ni-4%C alloy, powder of an Fe-30%Cr-8%Mo-4%C alloy, powder of an Fe-30%Cr-8%Mo-3%Co-4%C alloy, powder of an Fe-16%Cr-4%Mo-3%Nb-5%Ni-4.5%C alloy, powder of an Fe-25%Cr-3%Mo-0.5%V-5%Co-5%C alloy, and powder of an Fe-10%Cr-5%Mo-5%W-1%Nb-4.5%C alloy, all having a mean grain size of 5–6 microns, powder of Mo, powder of W, powder of Co, and powder of Ni, all having a mean grain size of 2 microns, powder of TiC, powder of ZrC, powder or HfC, powder of VC, powder of NbC, and powder of TaC, all having a mean grain size of 1.5 microns, and powder of graphite having a mean grain size of −350 mesh were prepared. The alloy powders other than the Fe-Cr alloy powder were prepared by mixing powder of C into respective metal oxide powders blended in respective predetermined blending ratios, and subjecting the mixed powers to heat reducing treatment under a reducing atmosphere (Co-reducing Method). These starting powders were blended into blending ratios shown in Table, and the blended powders were mixed

TABLE 1

| Specimens | Chemical Composition (Wt %) C | Cr | Mo | Ti | Zr | Hf | V | Nb | Ta | Co | Ni | W | FE + Inevitable Impurities | Percentage of Dispersed Carbides (Vol. %) | Theoretical Density Ratio (%) | Hardness (HRC) | Maximum Wear Depth (μm) | Maximum Wear Depth of Cam Member (μm) |
|---|---|---|---|---|---|---|---|---|---|---|---|---|---|---|---|---|---|---|
| Fe-base Sintered Alloy Chips of Present Invention | | | | | | | | | | | | | | | | | | |
| 1 | 4 | 25 | 10 | — | — | — | — | 1.5 | — | — | — | — | bal. | 73 | 99 | 61 | 39 | 72 |
| 2 | 5 | 25 | 10 | — | — | — | — | 1.5 | — | — | — | — | " | 85 | 99 | 64 | 34 | 66 |
| 3 | 6.5 | 25 | 10 | — | — | — | — | 1.5 | — | — | — | — | " | 97 | 99 | 71 | 20 | 55 |
| 4 | 5 | 10 | 10 | — | — | — | — | 1.5 | — | — | — | — | " | 75 | 99 | 62 | 35 | 70 |
| 5 | 5 | 40 | 10 | — | — | — | — | 1.5 | — | — | — | — | " | 90 | 98 | 70 | 24 | 62 |
| 6 | 5 | 25 | 2 | — | — | — | — | 1.5 | — | — | — | — | " | 77 | 99 | 64 | 37 | 68 |
| 7 | 5 | 25 | 25 | — | — | — | — | 1.5 | — | — | — | — | " | 89 | 98 | 68 | 28 | 59 |
| 8 | 5 | 25 | 10 | — | — | — | — | 0.1 | — | — | — | — | " | 83 | 99 | 65 | 36 | 70 |
| 9 | 5 | 25 | 10 | — | — | — | — | 5 | — | — | — | — | " | 87 | 98 | 72 | 30 | 78 |
| 10 | 5 | 25 | 10 | 0.1 | — | — | — | — | — | — | — | — | " | 84 | 98 | 67 | 38 | 74 |
| 11 | 5 | 25 | 10 | 4 | — | — | — | — | — | — | — | — | " | 87 | 98 | 71 | 36 | 77 |
| 12 | 2 | 25 | 10 | — | 0.1 | — | — | — | — | — | — | — | " | 79 | 98 | 64 | 33 | 68 |
| 13 | 5 | 25 | 10 | — | 2 | — | — | — | — | — | — | — | " | 86 | 98 | 65 | 31 | 70 |
| 14 | 5 | 25 | 10 | — | — | 1 | — | — | — | — | — | — | " | 84 | 98 | 64 | 32 | 71 |
| 15 | 5 | 25 | 10 | — | — | 4 | — | — | — | — | — | — | " | 87 | 98 | 67 | 34 | 74 |

TABLE 2

| Specimens | Chemical Composition (Wt %) C | Cr | Mo | Ti | Zr | Hf | V | Nb | Ta | Co | Ni | W | Fe + Inevitable Impurities | Percentage of Dispersed Carbides (Vol. %) | Theoretical Density Ratio (%) | Hardness (HRC) | Maximum Wear Depth (μm) | Maximum Wear Depth of Cam Member (μm) |
|---|---|---|---|---|---|---|---|---|---|---|---|---|---|---|---|---|---|---|
| Fe-base Sintered Alloy Chips of Present Invention | | | | | | | | | | | | | | | | | | |
| 16 | 5 | 25 | 10 | — | — | — | 0.5 | — | — | — | — | — | bal. | 83 | 99 | 63 | 36 | 65 |
| 17 | 5 | 25 | 10 | — | — | — | 3 | — | — | — | — | — | " | 86 | 98 | 65 | 30 | 67 |
| 18 | 5 | 25 | 10 | — | — | — | — | — | 0.1 | — | — | — | " | 85 | 99 | 64 | 37 | 68 |
| 19 | 5 | 25 | 10 | — | — | — | — | — | 5 | — | — | — | " | 87 | 98 | 66 | 29 | 62 |
| 20 | 5 | 25 | 10 | — | 1 | 1 | — | — | 1 | — | — | — | " | 86 | 99 | 65 | 31 | 65 |
| 21 | 5 | 25 | 3 | — | — | — | 0.5 | — | — | 5 | — | — | " | 82 | 99 | 63 | 35 | 63 |
| 22 | 5 | 25 | 10 | 1 | 1 | — | 1 | — | — | 2 | — | — | " | 85 | 98 | 64 | 30 | 66 |
| 23 | 5 | 25 | 10 | — | — | — | — | 1 | 0.5 | 10 | — | — | " | 84 | 99 | 65 | 28 | 59 |
| 24 | 5 | 25 | 10 | — | 0.1 | 0.1 | 1 | — | — | — | 0.1 | — | " | 83 | 99 | 64 | 35 | 64 |
| 25 | 4.5 | 16 | 4 | — | — | — | — | 3 | — | — | 5 | — | " | 80 | 99 | 63 | 33 | 68 |
| 26 | 5 | 25 | 10 | — | — | — | 0.5 | 3 | 1 | — | 15 | — | " | 82 | 99 | 61 | 32 | 65 |
| 27 | 5 | 25 | 10 | — | — | 2 | — | 3 | — | 5 | 5 | — | " | 88 | 98 | 64 | 27 | 71 |
| 28 | 5 | 25 | 10 | — | — | — | — | 1.5 | — | — | — | 0.1 | " | 85 | 99 | 65 | 35 | 66 |
| 29 | 4.5 | 10 | 5 | — | — | — | — | 1 | — | — | — | 5 | " | 76 | 99 | 63 | 37 | 61 |
| 30 | 5 | 25 | 10 | 1 | — | — | — | 1 | — | — | — | 10 | " | 86 | 99 | 67 | 32 | 64 |

TABLE 3

| Specimens | Chemical Composition (Wt %) C | Cr | Mo | Ti | Zr | Hf | V | Nb | Ta | Co | Ni | W | Fe + Inevitable Impurities |
|---|---|---|---|---|---|---|---|---|---|---|---|---|---|
| Fe-base Sintered Alloy Chips of Present Invention | | | | | | | | | | | | | |
| 31 | 5 | 25 | 10 | — | — | — | — | 1.5 | 1 | 1 | — | 1 | bal. |
| 32 | 5 | 25 | 10 | — | 0.1 | 0.1 | 0.5 | — | 0.5 | 0.5 | 0.5 | 1 | " |
| 33 | 5 | 25 | 10 | 1 | 1 | 1 | — | 0.5 | — | 3 | 2 | 7 | " |
| Comparative Fe-base Sintered Alloy Chips | | | | | | | | | | | | | |
| 1 | 3* | 25 | 10 | — | — | — | — | — | 1.5 | — | — | — | " |
| 2 | 5 | 8* | 10 | — | — | — | — | — | 1.6 | — | — | — | " |
| 3 | 5 | 25 | 1.5* | — | — | — | — | — | 1.5 | — | — | — | " |
| 4 | 5 | 25 | 10 | —* | —* | —* | —* | —* | —* | — | — | — | " |
| 5 | 5 | 25 | 10 | 6* | — | — | — | — | — | — | — | — | " |
| 6 | 5 | 25 | 10 | — | 6* | — | — | — | — | — | — | — | " |
| 7 | 5 | 25 | 10 | — | — | 6* | — | — | — | — | — | — | " |
| 8 | 5 | 25 | 10 | — | — | — | 6.5* | — | — | — | — | — | " |
| 9 | 5 | 25 | 10 | — | — | — | — | 6* | — | — | — | — | " |
| 10 | 5 | 25 | 10 | | 3* | — | — | — | 3* | — | — | — | " |
| 11 | 5 | 25 | 10 | 2* | — | — | 1.5* | 2* | 1* | — | — | — | " |
| 12 | 5 | 25 | 10 | — | — | — | — | — | 1.5 | — | — | — | " |

| Specimens | Percentage of Dispersed Carbides (Vol. %) | Theoretical Density Ratio (%) | Hardness (HRC) | Maximum Wear Depth (μm) | Maximum Wear Depth of Cam Member (μm) |
|---|---|---|---|---|---|
| Fe-base Sintered Alloy Chips of Present Invention | | | | | |

TABLE 3-continued

| | | | | | |
|---|---|---|---|---|---|
| 31 | 86 | 99 | 66 | 31 | 68 |
| 32 | 85 | 99 | 65 | 30 | 64 |
| 33 | 87 | 98 | 68 | 29 | 70 |
| | | Comparative Fe-base Sintered Alloy Chips | | | |
| 1 | 65* | 99 | 58 | 83 | 125 |
| 2 | 67* | 99 | 59 | 110 | 155 |
| 3 | 74 | 99 | 56 | 72 | 90 |
| 4 | 83 | 99 | 62 | 60 | 88 |
| 5 | 88 | 97 | 73 | 125 | 230 |
| 6 | 87 | 97 | 72 | 110 | 215 |
| 7 | 87 | 97 | 71 | 120 | 245 |
| 8 | 89 | 97 | 72 | 135 | 30 |
| 9 | 88 | 98 | 73 | 120 | 255 |
| 10 | 87 | 98 | 72 | 145 | 290 |
| 11 | 88 | 98 | 71 | 130 | 285 |
| 12 | 84 | 94* | 54 | pitting | 370 |

*falls outside the range of the present invention under conventional conditions. The mixed powders were compressed under a pressure within a range from 5 to 7 tons/cm$^2$ into green compacts, and the green compacts were sintered by soaking them in a vacuum atmosphere of $5\times10^{-2}$ torr at a predetermined temperature within a range from 1050° to 1200° C. and for 1 hour. Then, the sintered bodies were gradually cooled in such a manner that they were cooled from 1000° to 600° C. in a period of time within a range from 1 to 10 hours so as to cause carbides to be precipitated in the matrix. In this manner, Fe-base sintered alloy chips Nos. 1–33 according to the present invention and comparative Fe-base sintered alloy chips No. 1–12 were prepared, which have the same chemical compositions as the respective blending ratios shown in Table, and values of percentage of dispersed carbides, values of theoretical density ratio, and values of Vicker's hardness which are shown in Table.

The comparative Fe-base sintered alloys each have the content of at least one component (percentage of dispersed carbides) and/or theoretical density ratio falling outside the range of the present invention, as asterisked in Table.

The Fe-base sintered alloy chips Nos. 1–33 according to the present invention and the comparative Fe-base sintered alloy chips Nos. 1–12 were each mounted into a surface of a rocker arm formed of aluminum to serve as a sliding surface by means of internal chilling during die casting of the rocker arm, and were subjected to a wear resistance test under the following testing conditions:

Fuel: LPG;
Engine Speed: 800 rpm;
Cam Member (Counterpart): Chilled Casting;
Lubricating Oil: Deteriorated Oil at 80° C.;
Operating Time: 400 hours;
Load on Rocker Arm: 1.5 times as large as a normal value After operation of the rocker arms, the alloys mounted in the rocker arms and the cam members were measured in respect of maximum wear depth, the results of which are shown in Table.

It will be learned from Table that the Fe-base sintered alloy chips Nos. 1–33 according to the present invention show excellent wear resistance, are free from wear such as scuffing or pitting and show lower degrees of damaging or abrading the counterparts, even if they have been operated in a severe condition wherein LPG is used which has poor lubricity and can cause shortage of an oil film between the sliding part and the counterpart and a high load is applied on the rocker arm, whereas the comparative Fe-base sintered alloy chips Nos. 1–12, which each have the content of at least one of the components and/or the theoretical density ratio falling outside the range of the present invention, show inferiority in respect of resistance to pitting wear and wear resistance to the alloys of the present invention, and also show higher degrees of damaging or abrading that this inferiority becomes remarkable if the theoretical density ratio is less than 97%.

What is claimed is:

1. A carbide-dispersed type Fe-base sintered alloy consisting essentially of: 4–6.5% by weight C; 10–40% by weight Cr; 2–25% by weight Mo; 0.1–5% by weight at least one element selected from the group consisting of Ti, Zr, Hf, V, Nb, and Ta; and the balance of Fe and inevitable impurities, said alloy being produced by sintering a green compact into a sintered body at a temperature above 1000° C. and then gradually cooling said sintered body from 1000° to 600° C. over a period of time from 1 to 10 hours, said alloy having a structure wherein carbides are dispersed throughout the matrix in an amount of at least 71% by volume, said alloy having at least 97% theoretical denstiy ratio.

2. The carbide-dispersed type Fe-base sintered alloy of claim 1 consisting essentially of: 4.2–5% by weight C; 15–30% by weight Cr; 3–10% by weight Mo; 0.5–3% by weight at least one element selected from the group consisting of Ti, Zr, Hf, V, Nb, and Ta; and the balance of Fe and inevitable impurities.

3. A carbide-dispersed type Fe-base sintered alloy consisting essentially of: 4–6.5% by weight C; 10–40% by weight Cr; 2–25% by weight Mo; 0.1–5% by weight at least one element selected from the group consisting of Ti, Zr, Hf, V, Nb, and Ta; 0.1–15% by weight at least one element selected from the group consisting of Co and Ni; and the balance of Fe and inevitable impurities, said alloy being produced by sintering a green compact into a sintered body at a temperature above 1000° C. and then gradually cooling said sintered body from 1000° to 600° C. over a period of time from 1 to 10 hours, said alloy having a structure wherein carbides are dispersed throughout the matrix in an amount of at least 71% by volume, said alloy having at least 97% theoretical density ratio.

4. The carbide-dispersed type Fe-base sintered alloy of claim 3 consisting essentially of: 4.2–5% by weight C; 15–30% by weight Cr; 3–10% by weight Mo; 0.5–3% by weight at least one element selected from the group consisting of Ti, Zr, Hf, V, Nb, and Ta; 1–6% by weight at least one element selected from the group consisting of Co and Ni; and the balance of Fe and inevitable impurities.

5. A carbide-dispersed type Fe-base sintered alloy consisting essentially of: 4–6.5% by weight C; 10–40% by weight Cr; 2–25% by weight Mo; 0.1–5% by weight at least one element selected from the group consisting of Ti, Zr, Hf, V, Nb, and Ta; 0.1–10% by weight W; and the balance of Fe and inevitable impurities, said alloy being produced by sintering a green compact into a sintered body at a temperature above 1000° C. and then gradually cooling said sintered body from 1000° to 600° C. over a period of time from 1 to 10 hours, said alloy having a structure wherein carbides are dispersed throughout the matrix in an amount of at least 71% by volume, said alloy having at least 97% theoretical density ratio.

6. A carbide-dispersed type Fe-base sintered alloy of claim 5 consisting essentially of: 4.2–5% by weight of C; 15–30% by weight Cr; 3–10% by weight Mo; 0.5–3% by weight at least one element selected from the group consisting of Ti, Zr, Hf, V, Nb, and Ta; 1–5% by weight W; and the balance of Fe and inevitable impurities.

7. A carbide-dispersed type Fe-base sintered alloy consisting essentially of: 4–6.5% by weight C; 10–40% by weight Cr; 2–25% by weight Mo; 0.1–5% by weight at least one element selected from the group consisting of Ti, Zr, Nf, V, Nb, and Ta; 0.1–15% by weight at least one element selected from the group consisting of Co and Ni; 0.1–10% by weight W; and the balance of Fe and inevitable impurities, said alloy being produced by sintering a green compact into a sintered body at a temperature above 1000° C. and then gradually cooling said sintered body from 1000° to 600° C. over a period of time from 1 to 10 hours, said alloy having a structure wherein carbides are dispersed throughout the matrix in an amount of at least 71% by volume, said alloy having at least 97% theoretical density ratio.

8. A carbide-dispersed type Fe-base sintered alloy of claim 7 consisting essentially of: 4.2–5% by weight C; 15–30% by weight Cr; 3–10% by weight Mo; 0.5–3% by weight at least one element selected from the group consisting of Ti, Zr, Hf, V, Nb, and Ta; 1–6% by weight at least one element selected from the group consisting of Co and Ni; 1–5% by weight W; and the balance of Fe and inevitable impurities.

* * * * *